United States Patent [19]

Bond

[11] 4,349,288

[45] Sep. 14, 1982

[54] PERSONAL CLEANSING ARTICLE FOR RECTO-GENITAL REGION

[76] Inventor: Helen I. Bond, 709 Olson Rd., Longview, Wash. 98632

[21] Appl. No.: 205,740

[22] Filed: Nov. 10, 1980

[51] Int. Cl.[3] ..... A47L 13/19; A61M 35/00

[52] U.S. Cl. ..... 401/7; 128/260; 128/269; 401/8; 401/26; 401/266

[58] Field of Search ..... 401/6-8, 401/132, 266, 139, 26, 27; 128/260, 268, 269

[56] References Cited

U.S. PATENT DOCUMENTS

| | | | |
|---|---|---|---|
| 660,886 | 10/1900 | Bryan | 401/7 |
| 671,296 | 4/1901 | Rowand | 401/7 |
| 2,030,911 | 2/1936 | Borden | 401/266 |
| 2,790,982 | 5/1957 | Schneider | 401/7 |
| 2,795,806 | 6/1957 | Suttles | 401/7 |
| 2,999,265 | 9/1961 | Duane et al. | 206/525 X |
| 3,286,435 | 11/1966 | Weinberger | 206/812 X |
| 3,608,708 | 9/1971 | Storandt | 401/7 X |
| 3,635,567 | 1/1972 | Richardson, Jr. | 401/132 |
| 3,636,922 | 1/1972 | Ketner | 401/132 X |
| 3,775,014 | 11/1973 | Rosborne | 401/8 |
| 3,826,259 | 7/1974 | Bailey | 401/132 X |
| 3,883,897 | 5/1975 | Lefkowitz et al. | 401/7 X |
| 4,017,002 | 4/1977 | Doyle et al. | 206/205 X |

FOREIGN PATENT DOCUMENTS

| | | | |
|---|---|---|---|
| 1397340 | 3/1965 | France | 401/7 |

*Primary Examiner*—Steven A. Bratlie
*Attorney, Agent, or Firm*—George R. Nimmer

[57] ABSTRACT

Disclosed are personal cleansing articles for the recto-genital region, and offering especial convenience to travelers and others without ready access to dressing rooms and conventional bathing facilities. The articles generally comprise a laminar washcloth member, there being below the hydrophilic uppersurface thereof a liquid chargeable laminar-pouch with the pouch-throat being preferably relegated to the washcloth uppersurface that washably contacts the recto-genital anatomy. The user's outstretched hand, with the thumb extending into a thumbway component, supports the washcloth member; thus, this hand controllably expels cleansing liquid from the laminar-pouch toward the contacted recto-genital anatomy. There are desireably hand-engaging means (preferably offering fingertips protection) and hydrophobic barrier means between the laminar-pouch and the hand-engaging means. Foldably extending towel member, as well as other optional and interdependent features are also disclosed.

21 Claims, 15 Drawing Figures

10M
10
8
11L
10C
20M
16
11T
6
10D
60C
60
60D
11
300
50B
50
50A
20N
300A
10C
50
60D
10
10F
60F
60C
10D
300A
300 AP
SEAM
50B
10C
8
50C
59
59
10N
10M
PH
20N
11
20M
50A
10AE
50D
11T
6
8
60E
PHC
60D
11
300
10D
60C
6
20M
50A
PH
50D
60F
60E
PHC
60D
10

PERSONAL CLEANSING ARTICLE FOR RECTO-GENITAL REGION

Numerous male and female persons are susceptible to infections and irritations of the recto-genital region. Menstruating females, hemorrhoid victims, and diapered children have especial problems in this regard. Physicians and hygienists customarily advocate frequent treatment of the recto-genital region with appropriate cleansing liquids for the prevention and care of commonly encountered irritations and secretions thereat. Though tub bathing or other prolonged immersion of the entire recto-genital region offers the most thorough cleansing, traveling persons (especially menstruating females, hemorroid victims, and diapered children) for extended periods of time do not have access to bathing tubs and dressing rooms. Hence, many travelers who aspire to cleanse the recto-genital region must perform the cleansing task while being partially clad and awkwardly postured in confined quarters.

To aid in the cleansing of the recto-genital region by traveling persons, prior art workers have devised various personal hygienic articles. One such article is the disposable premoistened-applicator disclosed in U.S. Pat. Nos. 2,999,265, 3,057,467, 3,286,435, and 4,017,002. However, premoistened-applicators offer only superficial cleansing of the recto-genital anatomy, are cumbersome and manually untidy for the user, and expensive since only scant cleansing liquid is furnished by each disposable premoistened-applicator. Another personal cleansing article of the prior art is the bulbous squeezable-syringe having a lengthy outlet snout directable toward the recto-genital region. Such squeezable-syringes, by virtue of their bulbous shape and lengthy snout outlet, are capable of directing ample amounts of user selected cleansing liquid toward any and all selected sub-regions of the recto-genital anatomy. However, squeezable-syringes require a high degree of skill to be employed by or upon a partially clad or awkwardly postured person. Both the premoistened-applicator and the squeezable-syringe cleansing articles of the prior art suffer from the disadvantage that drying of the previously cleansed recto-genital region requires convection or separate toweling, both drying procedures requiring prolonged maintenance of a partially clad and/or awkwardly postured state.

It is accordingly the general objective of the present invention to provide personal cleansing articles for especial use at the recto-genital anatomy, especially by and for traveling persons, and that overcomes the disadvantages and deficiencies of prior art cleansing articles. Ancillary general objectives include: providing a personal hygienic cleansing article adapted to direct ample cleansing liquid to any and all selected anatomical sub-regions, that is quick, convenient, and reliable in use even in a cramped restroom stall or other confined quarters, that does not require a high degree of manipulative skill eventhough the user might be awkwardly postured or in confined quarters, that is not apt to mess the user's hands, thighs, and ancillary garments, that is compactly laminar in shape in counter-distinction to bulbous squeezable-syringes, that might be of economical form, and that may be provided with optional features to enhance cleansing and subsequent drying of the recto-genital regions.

With the above and other objects and advantages in view, which will become more apparent as this description proceeds, the personal cleansing article concept of the present invention typically comprises a flexible laminar washcloth member adapted to be supported upon the user's outstretched hand and including a hydrophilic uppersurface for washably contacting the recto-genital region, a laminar-pouch lying below and substantially parallel to said uppersurface and chargeable with a cleansing liquid through a pouch-throat relegated to the uppersurface at a location conveniently spaced from a thumbway or thumb-opening, said laminar-pouch when manually pressed from the washcloth lowersurface controllably expelling cleansing liquid from the pouch-throat to the contacted anatomy, there being hand-engaging means under the washcloth member and also hydrophobic barrier means to retard cleansing liquid seepage from the laminar-pouch and uppersurface to the hand-engaging means, preferably also a flexible laminar towel member in foldably associated relationship to the washcloth member, together with interdependent optional features to enhance cleansing, user cleanliness, and overall efficiency and ready utility of the personal cleansing articles.

In the drawing, wherein like characters refer to like parts in the several views, and in which.

Figure 1:
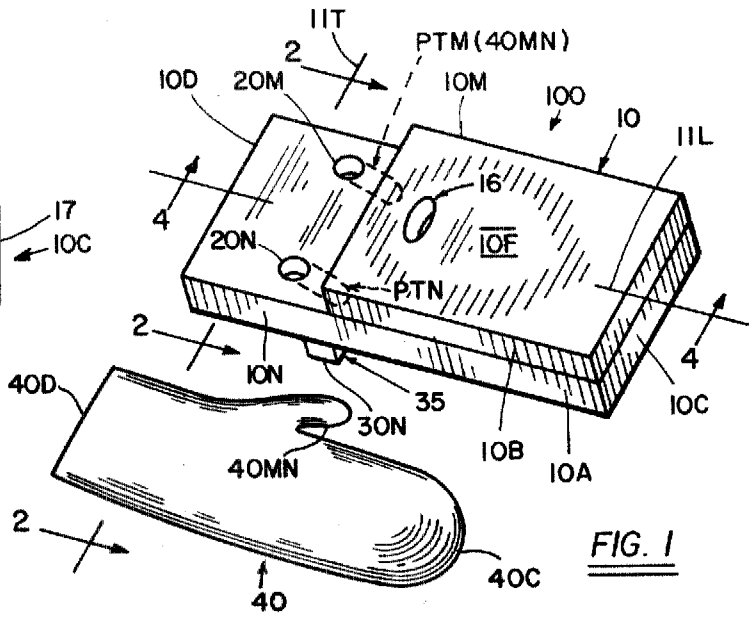
FIG. 1 is an exploded perspective view of a separable-components embodiment of the personal cleansing article of the present invention.

Turning initially to FIGS. 1–4 which depict a separable-components embodiment 100 of the personal cleansing article of the present invention comprising a flexible laminar washcloth member 10, thumbopenings 20M and 20N, hand-engaging means 30, and a hand-sheath type hydrophobic barrier means 40. Washcloth member 10 extends longitudinally along a central-axis 11L and is peripherally defined by a transverse lead-end 10C, a transverse trail-end 10D, and two longitudinally extending cloth-edges including left-edge 10M and right-edge 10N. Cloth edges 10M and 10N flank longitudinal-axis 11T, and ends 10C and 10D flank imaginary transverse-reference 11T. Washcloth member 10 has two opposed broad surfaces generally defined as uppersurface 10F and lowersurface 10E, the uppersurface 10F being hydrophilic substantially throughout for aptly washably contacting the selected recto-genital anatomy. The generally defined (10E) lowersurface is adapted to rest against the palm of the user's outstretched hand "PH". A longitudinally extending laminar-pouch 15 is sandwiched between said broad surfaces 10E and 10F, said laminar-pouch 15 having a single pouch-throat 16 relegated to uppersurface 10F for permitting charging and expulsion of cleansing liquid of pouch 15. It can be appreciated that whenever the user's outstretched hand "PH" presses against the washcloth lowersurface 10E, the cleansing liquid might be gently controllably expelled from pouch-throat 16 to flood uppersurface 10F and the contacted recto-genital part to be cleansed. Though the laminar-pouch (15) and the pouch-throat (16) might be furnished in numerous ways, washcloth member embodiment 10 conveniently comprises two laminae 10A and 10B of hydrophilic material (such as textile cloth, sturdy non-woven cellulose, etc.) peripherally attached with adhesive 17. A transversely elongated hole of the longitudinally shorter upper layer 10B provides the pouch-throat 16 depicted in FIGS. 1-4.

To facilitate manual control of the cleansing liquid to the desired anatomical sub-region, to accommodate the user's dextrously preferred hand "PH", and to generally control the article, there is a pair of substantially transversely aligned thumbopenings 20M and 20N through washcloth member 10. In longitudinal position, the thumbopenings 20M and 20N are located between pouch-throat 16 and trail-end 10D, though desireably reachable therethrough to pouch-throat 16 by the user's protruding leftthumb "PTM" or rightthumb "PTN". In this vein, the thumbopenings 20M and 20N flank longitudinal-axis 11L thereby accommodating for said outstretched hand the dextrously preferred one i.e. right or left.

There are transversely hand-engaging means attached to the washcloth member and located below the lowersurface 10E, said means being adapted to maintain the palm of the user's outstretched hand toward the washcloth lowersurface 10E and to maintain the four finger-tips positioned within the washcloth periphery. For embodiment 100 of FIGS. 1-4, the hand-engaging means 30 comprises a transversely extending ribbon having its terminal lengths 30M and 30N attached to lowersurface 10E adjacent cloth edges 10M and 10N, respectively, whereby the ribbon medial length 35 sags below lowersurface 10E to accommodate therebetween the user's hand "PH". In longitudinal position, medial length 35 is slightly leadward of thumbopenings 20M and 20N to abut the base of the user's thumb.

There are hydrophobic barrier means to retard liquid seepage from the laminar-pouch 15 to the hand engaging means. For embodiment 100 of FIGS. 1-4, hydrophobic barrier means comprises a separable hand-sheath such as the thin plastic mitten 40 having ambidextrous appeal including trailward opening 40D, leadward fingertips restraint 40C, and thumbpart 40MN. Thus, preparatory to utilizing embodiment 100, the user dons hand-sheath 40, then extends the sheathed hand through hand-engaging means 30, thereby assuming the use configuration shown in FIGS. 2 and 3. Though FIGS. 2 and 3 arbitrarily depict a righthanded user with right thumb "PTN" protruding through the thumbopening 20N, a lefthanded user would extend the left thumb "PTM" through the other thumbopening 20M.

Turning now to FIGS. 5-8 depicting alternate embodiment 200 wherein a length 50 of resinous hydrophobic film attached to layer 10A provides the hand-engaging means and the hydrophobic barrier means. Resinous film 50 extends as primary layer 50A attached to layer 10A, such as by intervening adhesive layer 58. Since embodiment 200 does not employ a hand-sheath (e.g. 40), primary layer 50A preferably extends toward trail-end 10D so as to trailwardly (50D) maskably overlie the wrist of the user's outstretched hand "PH". Though the ribbon style (30) hand-engaging means might conceivably be employed for embodiment 200, embodiment 200 herein employs a secondary film layer 50B for the hand-engaging means, which layer 50B might be a foldback extension of primary layer 50A merging at 50C. In vertical alignment with cloth edges 10M and 10N, layers 50A and 50B are attached, as by intervening adhesive strips 59, to complete a hand-engaging means accessible at 50G and including fingertips restraint and protection at 50C. The trailward terminus 50G of foldback secondary layer 50B is preferably located nearer to washcloth trail-end 10D than to lead-end 10C whereby after use, the pocket-like hand-engaging and barrier means might be ultimately inverted to wrap the spent article. If the article is to be constructed so as to be disposable in a sewer system, the plastic materials for the hydrophobic barrier means e.g. 40, 50 might consist of polyvinyl alcohol, methyl cellulose, or other slowly hydratable resinous material. As will be explained in conjunction with FIGS. 14 and 15, the washcloth member 10 at its lead-end 10C might be turned down, following barrier layer 50 to 10ST to structurally reinforce the fingertips restraint means 50C.

Figures 9, 10, 11, 12, 13:
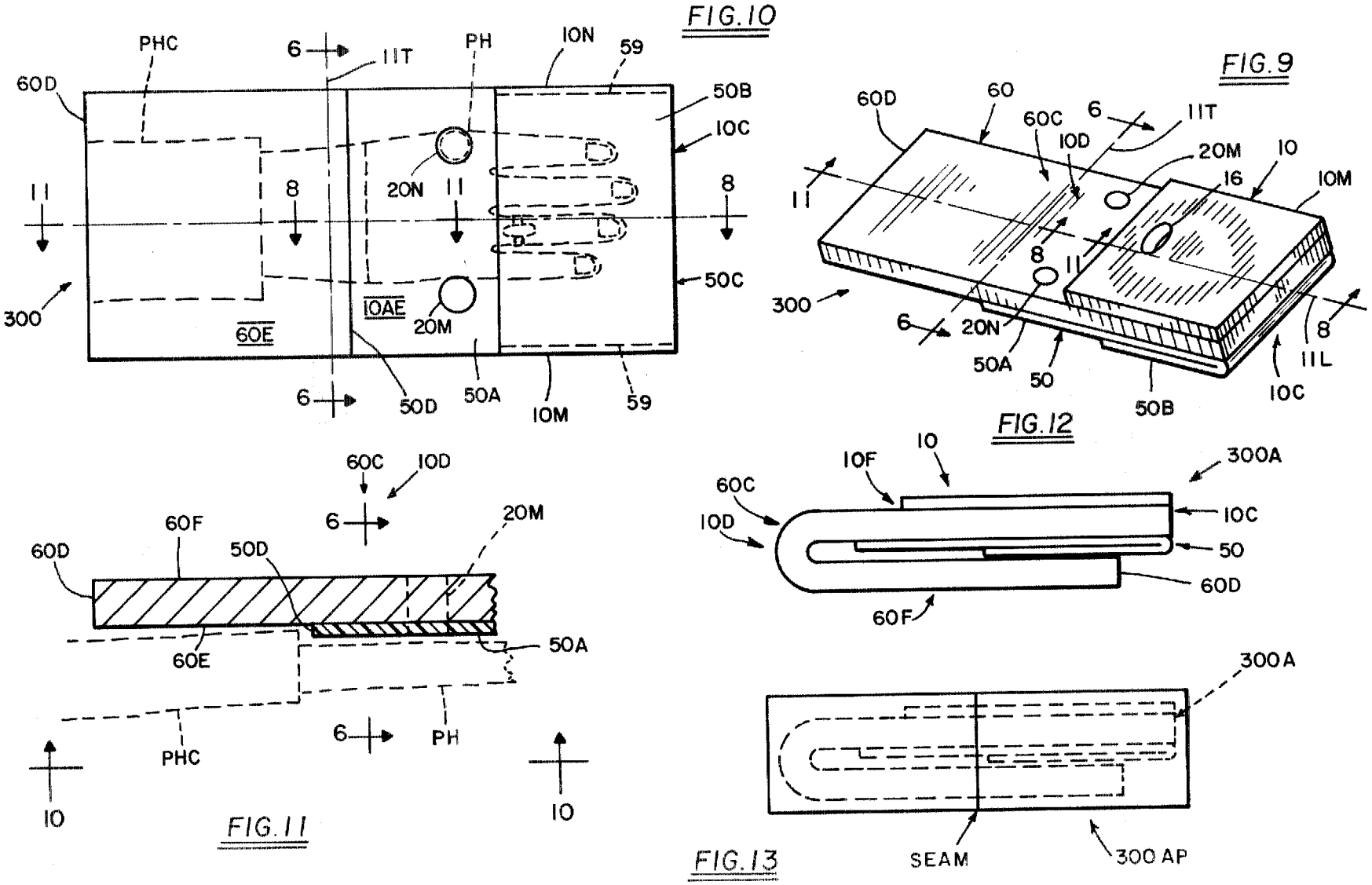
FIG. 9 is a perspective view of a toweled embodiment comprising the elements of the FIG. 5 embodiment.
FIG. 10 is a bottom plan view analagous to FIG. 7 of the FIG. 9 toweled embodiment.
FIG. 11 is a sectional elevational view taken along lines 11—11 of FIGS. 9 and 10.
FIG. 12 is an elevational view of the FIG. 9 toweled embodiment shown in folded condition.
FIG. 13 is an elevational view of the FIG. 9 folded toweled embodiment shown in a rupturable envelope package.

Alternate embodiment 300 of FIGS. 9-11 differs from embodiment 200 in that embodiment 300 includes a flexible laminar towel member 60 connected to the washcloth member and extending along central-axis 11L trailwardly from the washcloth trail-end 10D. Thus, the trailwardly (from 60C-60D) extending towel member 60 is there also available to maskedly overlie the wrist of the user's outstretched hand "PH" and garment cuff "PHC" during the cleansing step as well as to thereafter dry the cleansed recto-genital anatomy. As best seen in FIGS. 9 and 10, toweled embodiment 300 is preferably generally rectangular in plan view and lengthier longitudinally (11L) than along the transverse (11T) juncture 60C between the washcloth 10 and towel 60. Towel member 60 might be a trailward extension of the washcloth member structural material e.g. trailward extensions of layers 10A, 10B, 10R, 10S. Reference character 300A in FIGS. 12 and 13 indicates a foldably extending connected relationship between the washcloth 10 and the towel 60 members of toweled embodiment 300.

Figure 2:
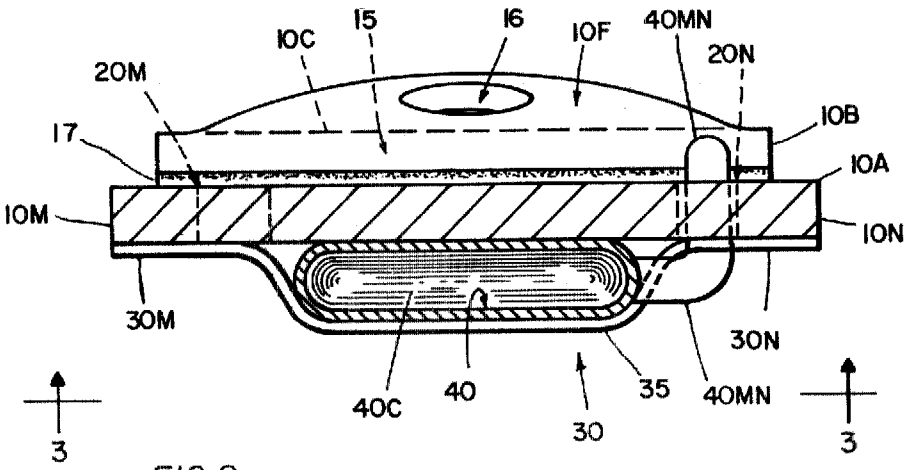
FIG. 2 is a transversely extending sectional elevational view taken along lines 2—2 of FIGS. 1, 3, and 4.
Figure 4:
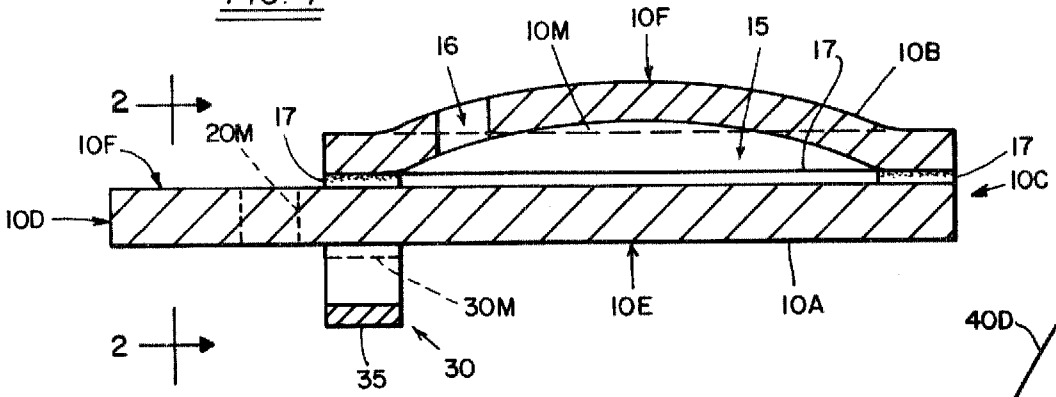
FIG. 4 is a longitudinally extending sectional elevational view of the washcloth component taken along line 4—4 of FIG. 1.
Figure 3:
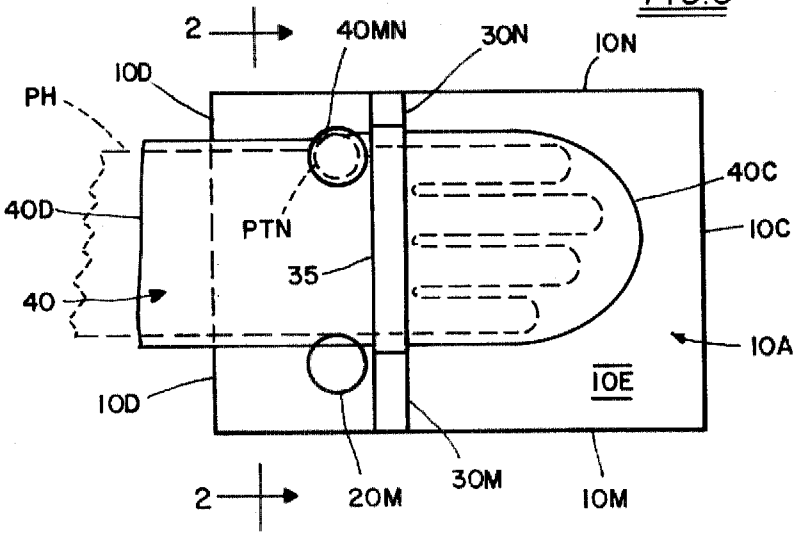
FIG. 3 is a bottom plan view taken along line 3—3 of FIG. 2 of the FIG. 1 separable-components embodiment.
Figure 5:
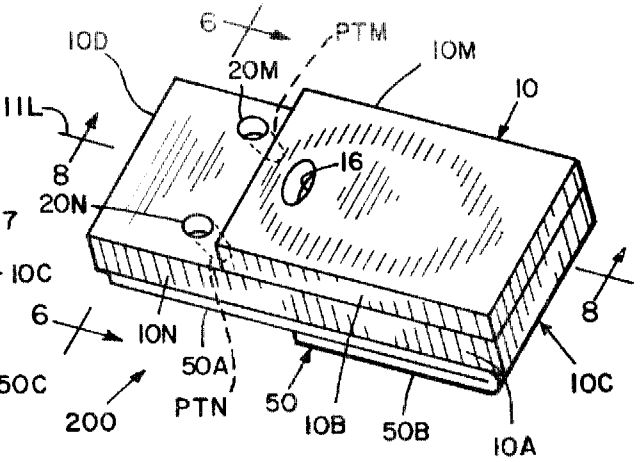
FIG. 5 is a perspective view of a unitary-components embodiment of the personal cleansing article of the present invention.
Figure 6:
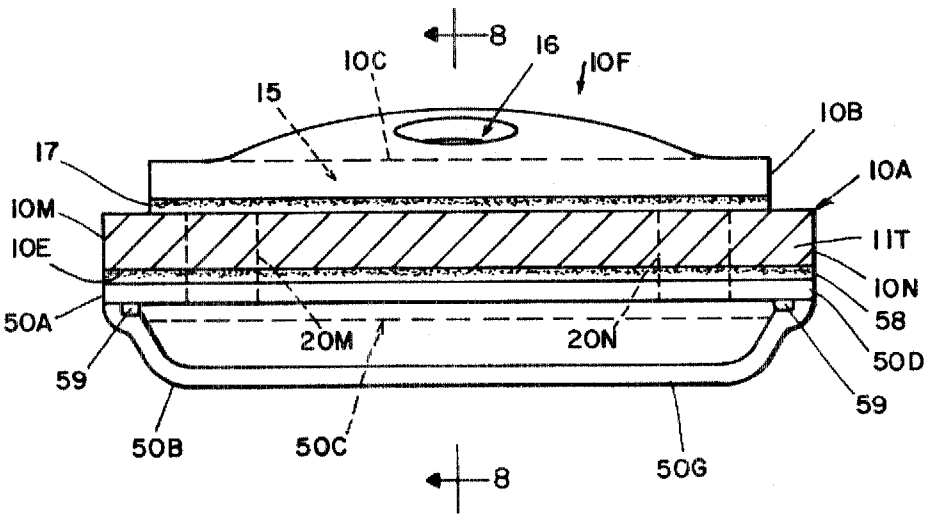
FIG. 6 is a transversely extending sectional elevational view analagous to FIG. 2 taken along lines 6—6 of FIGS. 5, 7, 8, 9, 10, and 11.
Figure 8:
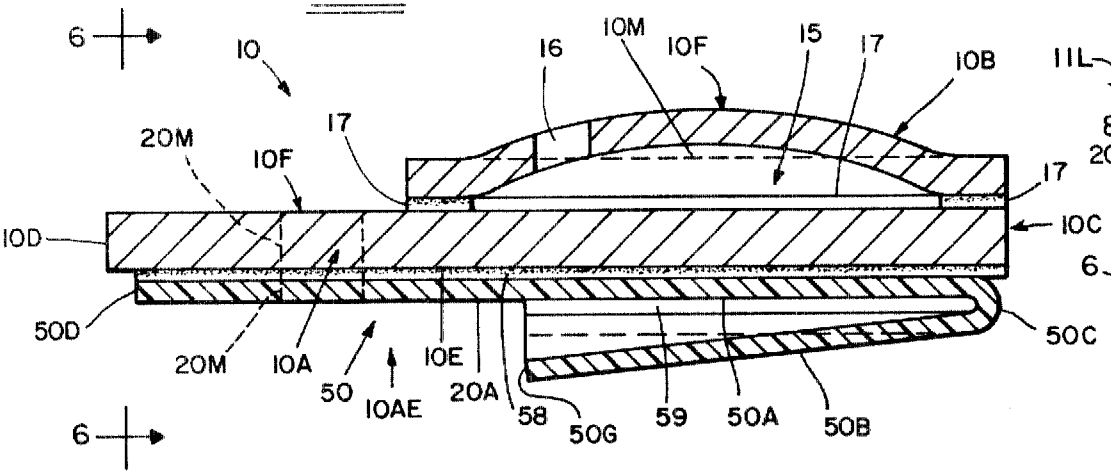
FIG. 8 is a longitudinally extending sectional elevational view taken along lines 8—8 of FIGS. 5, 6, 7, 9, and 10.
Figure 7:
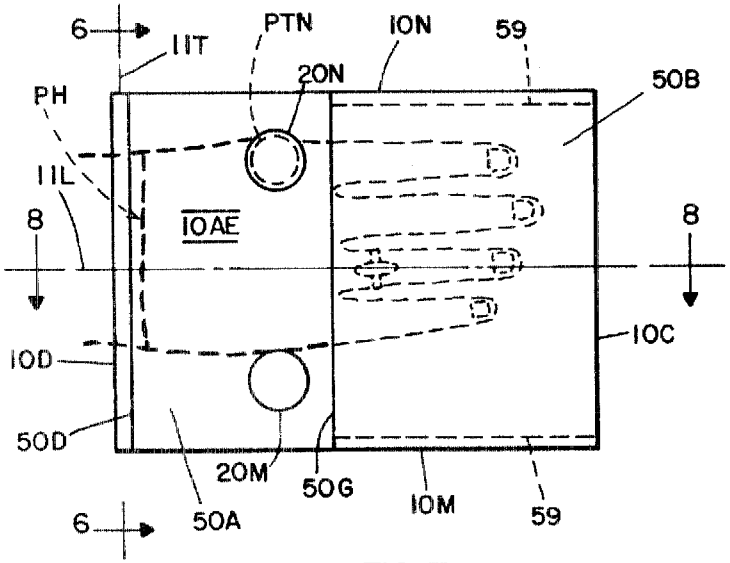
FIG. 7 is a bottom plan view analagous to FIG. 3 of the FIG. 5 embodiment.

FIG. 13 alludes to a manually rupturable envelope package e.g. 300AP, for the cleansing articles 100, 200, 200A, 300, etc. Within such rupturable commercial packages might be included: fitting 75 as shown in FIG. 15, extra hand-sheaths 40 as shown in FIG. 2, therapeutic ingredient chargeable into laminar-pouch 15, etc.

Figure 15:
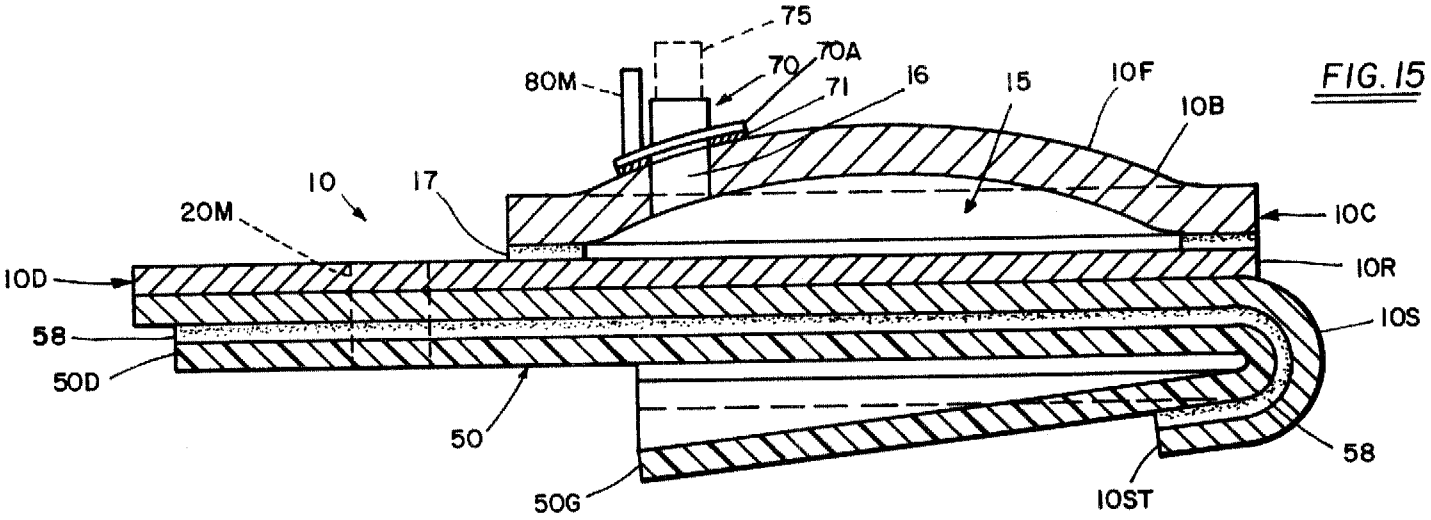
FIG. 15 is a sectional elevational view taken along line 15—15 of FIG. 14.
Figure 14:
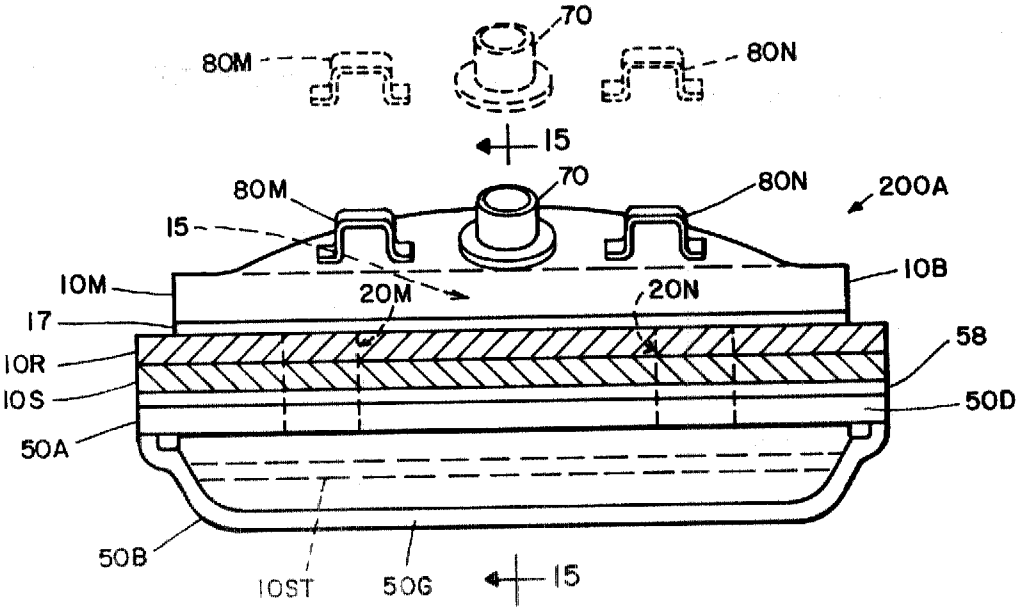
FIG. 14 is a sectional elevational view analagous to FIGS. 2 and 6 showing an alternate embodiment.

Alternate embodiment 200A of FIGS. 14 and 15 differs from embodiment 200 in three noteworthy respects. First, embodiment 200A utilizes two distinct layers 10R and 10S instead of a single layer 10A, layer 10S at 10ST contributing structurally to the fingertips restraint means 50C. Second, embodiment 200A includes a tubular outlet means extending upwardly from the washcloth member uppersurface 10F and in communicating relationship with pouch-throat 16; thus, manual ("PH") pressure augmented by squeezing gently controllably expels cleansing liquid through the tubular outlet means toward a selected sub-region of the recto-genital anatomy. Representative outlet means 70 comprises a flanged annular part (70A) surrounding pouch-throat 16 and adhesively (71) connected to uppersurface 10F; however, the annular part 70A alone might serve as a rudimentary tubular outlet means. Moreover, as indicated in phantom line in FIG. 15, a tubular fitting 75 might be removably engaged with the upright part of tubular outlet means 70. Third, embodiment 200A includes steadying means e.g. 80, for the tubular outlet means and controllable by the user's "free-hand" (meaning in counterdistinction to the underlying hand "PH"). The steadying means extends upwardly from the washcloth member uppersurface 10F and closely flanks the tubular outlet means (70) to permit dual-digits engagement. The steadying means 80 arbitrarily depicted in FIGS. 14 and 15 comprises two cord-like members 80M and 80N attached to upper layer 10B.

From the foregoing, the construction and operation of the personal cleansing articles will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. Personal cleansing article for the recto-genital region and comprising:

A. a flexible laminar washcloth member extending longitudinally along a central-axis and peripherally defined by a transverse lead-end, a transverse trail-end, and two longitudinally extending cloth-edges, said washcloth member having two opposed broad surfaces including uppersurface and lowersurface, said uppersurface having a finite surface-area and being hydrophilic substantially throughout for aptly contacting the recto-genital anatomy, the washcloth member being adapted to be supported by the palm of the user's outstretched hand, said washcloth member below the uppersurface including a longitudinally extending laminar-pouch, said laminar-pouch having a single pouch-throat relegated to the washcloth member uppersurface whereby hydrophilic cleansing liquid is chargeable into and is expelled from said laminar-pouch through said single pouch-throat, said cleansing liquid being gently controllably expelled from the laminar-pouch through the single pouch-throat to flood the uppersurface whenever the user's outstretched hand palm presses toward the washcloth member lowersurface;

B. a pair of substantially transversely aligned thumbopenings surrounded by the washcloth member periphery and extending vertically through the washcloth member on opposite sides of the central-axis thereby accommodating for said outstretched hand the dextrously preferred of the user's two hands, said thumbopenings being located trailwardly the washcloth member single pouch-throat;

C. a transversely extending hand-engaging means attached to the washcloth member and located below the lowersurface thereof so as to maintain the user's hand palm toward the washcloth member lowersurface and the fingertips positioned within the washcloth periphery; and D. hydrophobic barrier means to retard cleansing liquid seepage from the laminar-pouch to the hand-engaging means.

2. The cleansing article of claim 1 wherein the laminar-pouch is sandwiched between and lies substantially parallel to the washcloth member opposed broad surfaces; wherein the thumbopenings in longitudinal position are located slightly trailwardly of the pouch-throat whereby the selected thumb protruding therethrough is leadwardly reachable to directly overlie the laminar-pouch; and wherein the hydrophobic barrier means comprises at least one layer of resinous material extending along the central-axis and trailwardly beyond the thumbopenings so as to overlie the wrist of the user's outstretched hand.

3. The cleansing article of claim 2 wherein the hand-engaging means includes fingertips restraint and protection means.

4. The article of claim 3 wherein there is a flexible laminar towel member in foldably extending relationship to the washcloth member and extending longitudinally away from the washcloth member trail-end.

5. The article of claim 4 wherein the hydrophobic barrier member comprises at least one layer of resinous material attached to the washcloth member lowersurface and extending longitudinally trailwardly from the hand-engaging means to maskably overlie the wrist of the user's outstretched hand.

6. The article of claim 5 wherein the fingertips restraint means is at least partially provided by a turned down leadward portion of the washcloth member.

7. The cleansing article of claim 1 wherein there is a tubular outlet means extending upwardly from the washcloth member uppersurface and in direct communicating relationship with the pouch-throat whereby said outstretched hand manual pressure augmented by squeezing thereof gently controllably expels cleansing liquid through the tubular outlet toward a selected anatomical sub-region.

8. The cleansing article of claim 7 wherein there is user free-hand controllable steadying means for the tubular outlet means, said steadying means extending upwardly from the washcloth member uppersurface and closely flanking the tubular outlet means to permit dual-digital engagement; and wherein there is a flexible laminar towel member in foldably extending trailward relationship to the washcloth member.

9. The article of claim 8 wherein the steadying means is removably attached at the washcloth member uppersurface.

10. The article of claim 9 packaged within a manually rupturable envelope.

11. The article of claim 10 wherein a tubular fitting engageable with the tubular outlet means is packaged within said envelope.

12. The cleansing article of claim 1 wherein there is a flexible laminar towel member in foldably extending relationship to the washcloth member, said towel member extending along said central-axis trailwardly away from the washcloth member trail-end and being there also available to maskably overlie the wrist of the user's outstretched hand during the cleansing step as well as to thereafter dry the cleansed recto-genital anatomy, said article being generally rectangular in top plan view and lengthier along the central-axis than along the transverse trail-end juncture between washcloth and towel members.

13. The cleansing article of claim 12 wherein the hydrophobic barrier means comprises at least one layer of resinous material attached to the washcloth member and extending along the central-axis including also into the towel member realm so as to at least maskably overlie the wrist of the user's said outstreched hand.

14. The cleansing article of claim 13 wherein the said barrier layer includes a foldback length terminating as a transversely extending free-end located in longitudinal position trailwardly of the washcloth member lead-end, said foldback length being attached substantially parallel along the cloth-edges to the washcloth member to provide a pocket-like fingertips restraint means.

15. The article of claim 14 wherein the foldback length free-edge is located nearer the washcloth member trail-edge than to the lead-edge whereby the fingertips restraint and protection means might be ultimately inverted to wrap the spent article.

16. The article of claim 15 wherein the barrier layer consists of a resinous material slowly dissolvable in sewer water.

17. The article of claim 16 wherein the washcloth member at the transverse lead-end is turned down and follows the foldback length to structurally reinforce the fingertips restraint means.

18. The cleansing article of claim 1 packaged within a manually rupturable envelope.

19. The packaged article of claim 18 wherein at least one water-soluble therapeutic ingredient is contained within said envelope.

20. The cleansing article of claim 18 wherein the hydrophobic barrier means comprises a hydrophobic hand-sheath packaged within said manually rupturable envelope.

21. The cleansing article of claim 1 wherein there is a hydrophobic hand-sheath, said hand-sheath extending along said longitudinal central-axis and being located below the laminar-pouch.

* * * * *